US007191472B1

(12) United States Patent
Kishino

(10) Patent No.: US 7,191,472 B1
(45) Date of Patent: Mar. 20, 2007

(54) COLD PROOF GLOVE AND GLOVE PROVIDED WEAR

(75) Inventor: Etsuo Kishino, Yuzawa-machi (JP)

(73) Assignee: Kabushiki Kaisha Kurebu, Niigata (JP)

( * ) Notice: Subject to any disclaimer, the term of this patent is extended or adjusted under 35 U.S.C. 154(b) by 0 days.

(21) Appl. No.: 11/228,268

(22) Filed: Sep. 19, 2005

(51) Int. Cl.
*A41D 19/00* (2006.01)

(52) U.S. Cl. ..... 2/160; 2/159; 2/158; 2/161.6; 2/163

(58) Field of Classification Search ..... 2/160, 2/159, 158, 161.6, 161.1, 161.2, 163
See application file for complete search history.

(56) References Cited

U.S. PATENT DOCUMENTS

| | | | | | |
|---|---|---|---|---|---|
| 223,029 | A | * | 12/1879 | Dunton | 384/255 |
| 1,361,565 | A | * | 12/1920 | Christy | 2/313 |
| 1,478,582 | A | * | 12/1923 | Schallman | 2/164 |
| 1,786,227 | A | * | 12/1930 | Bruggeman | 2/159 |
| 1,796,319 | A | * | 3/1931 | Burden | 2/161.8 |
| 2,103,594 | A | * | 12/1937 | Murray | 2/160 |
| 2,496,734 | A | * | 2/1950 | Macreadie | 2/160 |
| 2,549,660 | A | * | 4/1951 | Buhl et al. | 2/158 |
| 2,603,790 | A | * | 7/1952 | Boehm-Myro | 2/158 |
| 5,406,649 | A | * | 4/1995 | Bolembach | 2/158 |
| 5,509,143 | A | * | 4/1996 | Yates et al. | 2/160 |
| 5,542,125 | A | * | 8/1996 | Zuckerwar | 2/158 |
| 5,642,527 | A | * | 7/1997 | Savage | 2/161.8 |
| 5,774,894 | A | * | 7/1998 | Yates et al. | 2/158 |
| 2003/0154537 | A1 | * | 8/2003 | Carey et al. | 2/160 |

FOREIGN PATENT DOCUMENTS

| | | |
|---|---|---|
| JP | 59-24719 U | 2/1984 |
| JP | 2-13443 Y2 | 4/1990 |
| JP | 9-256208 A | 9/1997 |
| JP | 2000-282310 | 10/2000 |
| JP | 2004-360119 | 12/2004 |
| JP | 2005-226185 | 8/2005 |

* cited by examiner

*Primary Examiner*—Katherine Moran
*Assistant Examiner*—Richale L. Haney
(74) *Attorney, Agent, or Firm*—Sughrue Mion, PLLC

(57) ABSTRACT

A cold proof glove characterized in that a receiving bag portion is provided in a hand back portion of a glove member, a mitten type cover member for covering substantially all of the glove member from its finger tip to its bottom portion is arranged and received in a such manner that the mitten-type cover member may be pulled out from the receiving bag portion as desired. The cover member is provided integrally with at least the glove member or the receiving bag portion.

4 Claims, 5 Drawing Sheets

COLD PROOF GLOVE AND GLOVE PROVIDED WEAR

BACKGROUND OF THE INVENTION

1. Field of the Invention

The present invention relates to a cold proof glove that is suitable for, for example, ski and snow board play and a glove provided wear to be used as, for example, cold proof wear.

2. Background Art

There are a five-finger type and a mitten type (which is in general a two-finger type but may be a three-finger type) as cold proof gloves for ski or snow board play.

The five-finger type glove has a merit that there is no unusual feeling when it is worn but has a demerit that it is inferior in a cold proof property because the fingers are separated one by one. The mitten type glove has a disadvantage that there is unusual feeling when it is worn but has an advantage that the cold proof property is good. Thus, it is difficult to select which one is better.

Also, conventionally, for the purpose of enhancing the cold proof performance or the water-proof performance, there is an externally covered mitten called a so-called over-mitten.

Then, if this over-mitten is used to cover the five-finger type cold proof glove from the outside, it is possible to enhance the cold proof performance to thereby overcome the disadvantage of the five-finger type glove.

In other words, if the five-finger type glove and the over-mitten type glove are used together, it is possible to keep the above-described merit of the five-finger type cold proof glove and to obtain the cold proof performance by covering the glove with the over-mitten to ensure the cold proof performance. Thus, it is safe to say that the over-mitten is very excellent in practical use.

However, this over-mitten should be carried always for the weather that is cold separately from the cold proof glove. Also, since the over-mitten is used to cover from the outside, there is a disadvantage that it is fallen and lost away.

Also, conventionally, as shown in Japanese Utility Model Publication No. Hei 2-13443 (Patent Publication 1), a hand back member from which portions corresponding four finger forks are cut away except for the portion corresponding to the thumb is provided, a pocket is formed on a back portion of the hand back member, and a hood for covering the forefinger, the middle finger, the ring finger and the little finger is stitched in the pocket to provide a hood cover for the glove which may be collapsed and received.

This glove hood cover is used to be overlapped and worn from above the glove. For example, the glove hood cover is attached on the five-finger type cold proof glove. When the finger tips are cooled, the hood collapsed and received in the pocket is taken out to cover the four fingers to exhibit the cold proof effect (warm effect).

Accordingly, by this glove hood cover, it is possible to solve the defect of the over-mitten since the glove hood cover does not have to be carried separately like the over-mitten and there is no fear that the glove hood cover falls away to be lost.

However, also since this glove hood cover is used to be attached from above the glove, there is a defect that, even if the hood is not used, as far as the hand back member is attached, the thickness of the palm portion is increased to degrade the gripping performance or the workability.

On the other hand, conventionally, a glove integral wear in which a glove is provided integrally with a cuff of a long sleeve and the glove may be received on the outer surface of the cuff has been proposed (see Patent Publication 2). By such a glove integral wear, may not only the glove be used when necessary but also the glove may be received when not necessary. It is thus possible to overcome the problem that the glove has to be carried separately from the wear or the problem of losing the glove.

However, in this proposal, an opening portion is provided in the tip end portion of the glove provided in the cuff or the middle of the palm or the back thereof and the glove is pulled back to the wrist side from the opening portion so that the glove is received in the cuff. Accordingly, it is likely that cold air or water is introduced from the opening portion of the tip end portion or the middle of the glove to degrade the cold proof function (water proof function) as the glove. In particular, in the case where the opening portion is on the palm side, the gripping effect of the glove is deteriorated.

Also, according to this conventional proposed, since the glove is exposed while the glove is attached on the outer surface of the cuff in the externally attached condition, this would never improve the aesthetic design or appearance.

Patent Publication 1: Japanese Utility Model Publication No. Hei 2-13443

Patent Publication 2: Japanese Patent Unexamined Publication No. 2000-282310

In view of the foregoing circumstances, in order to overcome the above-noted defects, an object of the present invention is to provide a novel cold proof glove, without any troublesome work to carry the glove discretely from cold proof glove or any fear that the glove is fallen down and lost, and in addition, or any fear that the workability of the cold proof glove is degraded when the over mitten is not worn, while providing a structure by an over mitten to ensure the cold proof function.

Also, in view of the foregoing circumstances, in order to overcome the above-noted defects, an object of the present invention is to provide a novel glove provided wear which has such a structure that a glove member may exhibit a cold proof function and a gripping function without fail and in addition, and the glove member may be received in or pulled out from a receiving bag portion provided along a sleeve portion of a wear member as desired whereby an outer appearance is improved when the glove member is not used (when the glove is received).

SUMMARY OF THE INVENTION

The present invention will now be described with reference to the drawings.

The invention relates to a cold proof glove characterized in that a receiving bag portion 2 is provided in a hand back portion of a glove member 1, a mitten type cover member 3 for covering almost all the glove member 1 from its finger tip to its bottom portion is arranged and received in a such manner that the cover member 3 may be pulled out as desired, and the cover member is provided integrally with at least one of the glove member 1 and the receiving bag portion 2 without separating therefrom.

In the cold proof glove according to the first aspect of the invention, according to a second aspect, a communication opening and closing portion 4, which may be opened and closed as desired, for communication an outside of the glove member 1 and an inside of the receiving bag portion 2 is provided in the sleeve portion of the glove member, and the cover member 3 is adapted to be capable of being received in and pulled out from the receiving bag portion 2 through the communication opening and closing portion 4 which is opened.

In the cold proof glove according to the second aspect of the invention, according to a third aspect, a part of the bottom portion of the cover member 3 is provided integrally with a portion close to the communication opening and closing portion 4 within the receiving bag portion 2.

In the cold proof glove according to any one of the first to third aspects of the invention, according to a fourth aspect of the invention, further comprises an attaching and detaching means for attaching and detaching the cover member 3 with respect to one of the glove member 1 and the receiving bag member 2.

In the cold proof glove according to any one of the first to third aspect of the invention, according to a fifth aspect of the invention, a slit portion 5 is formed in the bottom portion of the cover member 3, and a fastening belt 6 externally provided on a wrist portion of the glove member 1 through the slit portion 5 is exposed so that the fastening belt 6 may be provided outside of the wrist portion of the cover member 3.

In the cold proof glove according to the fourth aspect of the invention, according to a sixth aspect of the invention, a slit portion 5 is formed in the bottom portion of the cover member 3, and a fastening belt 6 externally provided on a wrist portion of the glove member 1 through the slit portion 5 is exposed so that the fastening belt 6 may be provided outside of the wrist portion of the cover member 3.

According to a seventh aspect of the invention, there is provided a glove provided wear characterized in that a receiving bag portion 8 is provided along a sleeve portion 70 of a wear member 7, a glove member 9 which may cover at least all the hand is arranged and received in such a manner that the glove member 9 may be received and pulled out as desired is provided within the receiving bag 8, the glove member 9 is provided integrally with at least one of the sleeve portion 70 of the wear member 7 and the receiving bag portion 8 and the glove member 9 pulled out from the receiving bag 8 may be worn on the hand exposed outside from a cuff 70A through the sleeve portion 70.

Also, in the glove provided wear according to the seventh aspect of the invention, the receiving bag portion 8 is provided in a hand back portion of the sleeve portion 70, an opening portion 8A of the receiving bag portion 8 is provided in a portion close to a cuff 70A of the sleeve portion 70, a receiving deep side of the receiving bag portion 8 is located on a proximal side 70A of the sleeve portion 70, and a hand back side portion of a bottom portion of the glove member 9 is provided integrally with one of the hand back side portion of the sleeve portion 70 and the receiving bag portion 8.

Also, in the glove provided wear according to the seventh aspect of the invention, according to a ninth aspect of the invention, the opening portion 8A of the receiving bag portion 8 is formed to be openable and closeable, the glove member 9 may by received and pulled out from the receiving bag portion 8 through opening portion 8A which is opened.

Also, in the glove provided wear according to the eighth aspect of the invention, according to a tenth aspect of the invention, the opening portion 8A of the receiving bag portion 8 is formed to be openable and closeable, the glove member 9 may by received and pulled out from the receiving bag portion 8 through opening portion which is opened.

Also, in the glove provided wear according to any of the aspect to the seventh to tenth aspects of the invention, according to an eleventh aspect of the invention, at least one of the glove member 9 and a joint portion 10 between the receiving bag portion 8 or the sleeve portion 70 of the wear member 7 is made of material having expandability.

Also, the glove provided wear according to any one of the seventh to tenth aspects of the invention, according to a twelfth aspect of the invention, further comprises an attaching and detaching means for attaching and detaching the glove member 9 with respect to one of the sleeve portion 70 of the wear member 7 and the receiving bag member 8.

Also, the glove provided wear according to the eleventh aspect, according to a thirteenth aspect of the invention, further comprises an attaching and detaching means for attaching and detaching the glove member 9 with respect to one of the sleeve portion 70 of the wear member 7 and the receiving bag member 8.

With the invention according to the first aspect of the invention constructed as described above, since the cover member may be received in the receiving bag portion so that the cover member will not serves as an obstruction, it is not necessary to carry the cover member separately from the cold proof glove as in the conventional over mitten, and also, since the receiving bag portion is provided on the hand back portion of the glove member, the palm portion of the glove member exhibits the same workability and function as those of the conventional cold proof glove. In addition, it is possible to impart the cold proof property to almost all the glove member by a simple operation to cover almost all the portion of the glove member from its finger tip to its bottom portion by pulling out the cover member from the receiving bag member. In this case, since the cover member is provided integrally with the glove member or the receiving bag portion, for example, there is no fear that the cover member would be fallen down and lost. Thus, the glove may serve as the cold proof glove that is superior in practical use.

Also, according to the second aspect of the invention, it is possible to easily feasibly design the receiving and pulling-out structure of the cover member to the receiving bag portion. In addition, for example, it is possible to keep a good outer appearance in the same manner as in the conventional cold proof glove without the cover member being exposed outside to thereby provide a structure of the cold proof glove which is much more superior in practical use.

Also, according to the third aspect of the invention, it is possible to easily feasibly design the structure provided integrally with the receiving bag portion for the cover member that may cover almost all the portion from the finger tip to the bottom portion of the glove member to thereby provide the cold proof means having the structure which is much more superior in practical use.

Also, according to the fourth aspect of the invention, for example, it is possible to wash the cover member by detaching the cover member away from the glove member to thereby provide the cold proof glove having the structure which is much more superior in practical use.

Also, according to the fifth and sixth aspects of the invention, the cover member covers the glove member so as not to deteriorate the function of the fastening belt that is originally provided in the cold proof glove such as a snow board glove or a ski glove. Also, it is possible to fasten and fix the cover member by utilizing this fastening belt so that the cover member would hardly be pulled away. Thus, it is possible to provide the cold proof glove having the structure that is much more superior in practical use.

Since the invention according to the seventh aspect of the invention is thus constructed, if the glove provided wear according to the invention is worn, it is unnecessary to carry the glove separately, and there is no fear that the glove member is fallen down and lost. When the hand feels the cold, only if the glove member is pulled out from the receiving bag portion and is worn to the hand, it is possible to ensure the positive cold proof function at least over all the hand in the same manner as in the conventional glove, and at the same time, it is possible to ensure the gripping function as that of the conventional case. In addition, when the glove member is not used, the glove member is received in the receiving bag member provided in the sleeve portion so that the glove member will not serve as the obstruction against the manual work. Also, since it is possible to keep the good outer appearance which is not different from the conventional appearance of a regular wear, even if the glove is not needed, it is possible for the user to wear the glove provided wear without paying any attention to the outside appearance. Thus, it is possible to provide the novel glove provided wear that is extremely excellent in practical use.

Also, according to the eighth aspect of the invention, it is possible to feasibly design such a structure that the glove member pulled out from the receiving bag portion is mounted on the hand exposed from the cuff. The glove member that has been pulled out from the opening portion may readily be mounted on the hand. In addition, by the joint portion between the glove member located in a position on the hand back side and the sleeve portion or the receiving bag portion, it is possible to prevent the snow, water or cold air from entering the glove member (the bottom portion thereof) or the cuff from the outside (the hand back side) of the body, for example. It is possible to provide a glove provided wear having a structure that is much more superior in practical use.

Also, according to the invention defined in the ninth aspect and the tenth aspect, since the opening portion is closed so that the glove member is not exposed on the outer appearance of the wear member without fail, it is possible to provide a glove provided wear having a structure that is much more superior in practical use and that may exhibit the same outer experience as that of the conventional wear without fail.

Also, according to the eleventh aspect of the invention, since the glove member or the joint portion is expandable to the sleeve portion or the receiving bag portion, it is possible to readily attach or detach the glove member with respect to the hand exposed from the cuff. In addition, it is possible to obtain the comfortable mounting feel without tensioning the sleeve portion and the glove member when the glove member is worn, for example. It is thus possible to provide a glove provided wear having a structure that is much more superior in practical use.

Also, according to the twelfth and thirteenth aspects, for example, it is possible to clean the glove member by separating the glove member away from the wear member, which may provide a glove provided wear having a structure that is much more superior in practical use.

BEST MODE FOR EMBODYING THE INVENTION

Figure 1:
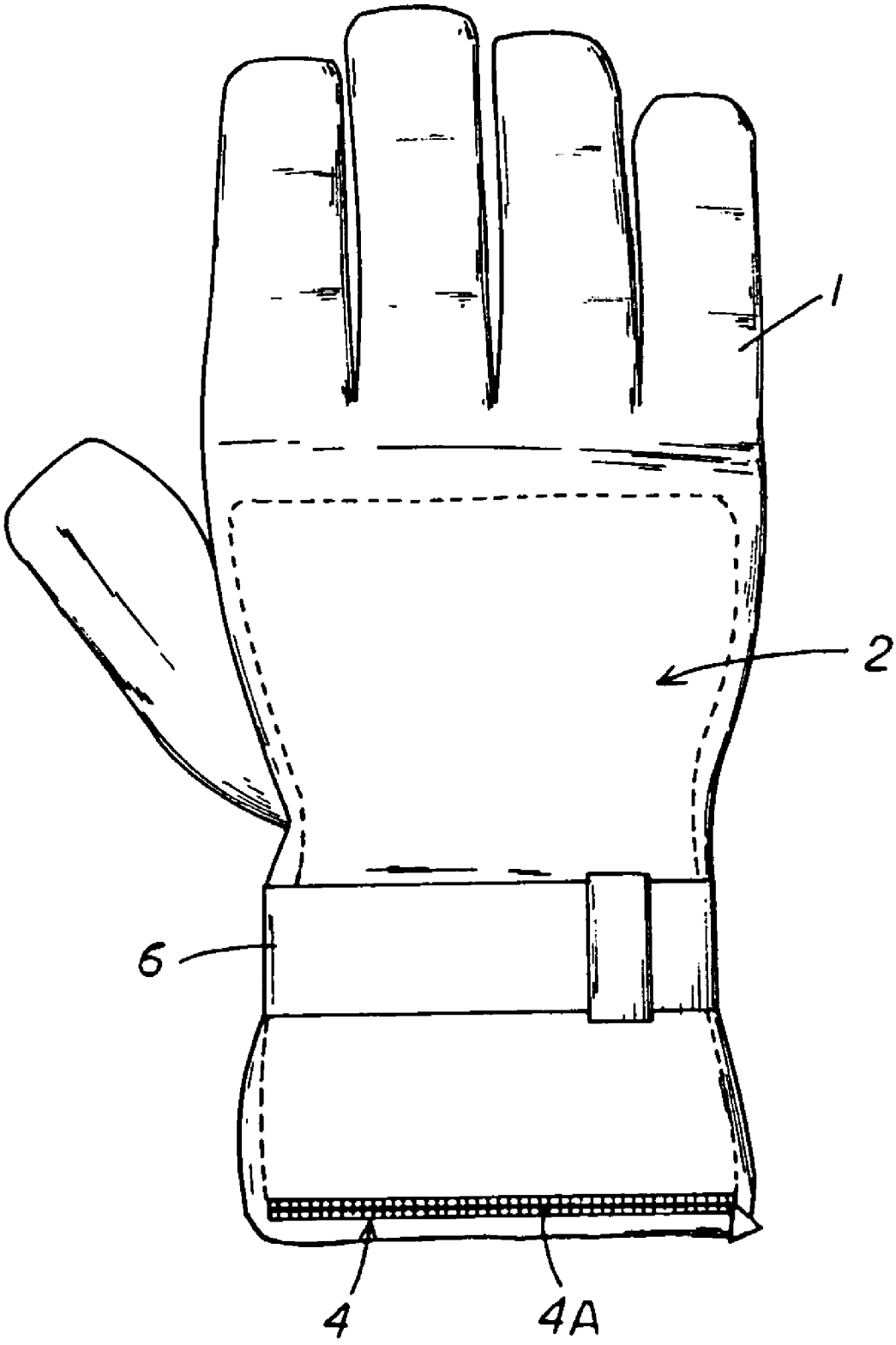
FIG. 1 is a frontal view showing a first embodiment.

A preferable embodiment of the present invention (how to embody the invention) will now be described in brief with reference to the drawings with the effects of the invention.

Invention according to the First Aspect

Usually, it is possible to receive the cover member 3 within the receiving bag portion 2 without serving as the obstruction. Accordingly, it is unnecessary to carry the cover member separately away from the cold proof glove as in the conventional over mitten.

Also, since the receiving bag portion 2 is provided in the back portion of the glove member 1, the cover member 3 does not affect at all against the palm portion of the glove member 1 even if the cover member 3 is kept under the received condition, so that this palm portion exhibits the same workability and function as those as the conventional cold proof glove.

When the finger tip feels cold, simply, the cover member 3 is pulled out from the receiving bag portion 2 and almost all the portion from the finger tip to the bottom portion of the glove member 1 is covered by the cover member 3 to thereby make it possible to enhance the cold proof function to the substantially overall glove member 1.

Also, in this case, there is no fear that the glove member 1 or the cover member 3 provided integrally with the receiving bag portion 2 is fallen down and lost.

Accordingly, although there is provided a structure that may ensure the cold proof function by the cover member 3 (over mitten), and there is no fear that the cover member is fallen down and lost or the cover member has to be carried separately away from the cold proof glove. In addition, the workability of the cold proof glove is not deteriorated when the cover member 3 is not used, for example. Thus, it is possible to provide a novel cold proof glove that is extremely superior in practical use.

Also, for example, if the communication opening and closing portion 4, which is openable and closeable, for communicating the outer portion of this glove member 1 and the inside of the receiving bag portion 2 with each other is provided in the bottom portion of the glove member 1 and the cover member 3 is received and pulled out from the receiving bag portion 2 through the opened communication opening and closing portion 4, it is possible to readily feasibly realize a structure of the receiving and pulling-out structure of the cover member 3 with respect to the receiving bag portion 2. In addition, the communication opening and closing portion 4 is closed so that the cover member 3 is not exposed on the outer experience to make it possible to keep the same outer experience as that of the conventional cold proof glove to thereby provide the glove that is much more excellent in practical use.

Also, for example, if a part of a sleeve edge of the cover member 3 is provided integrally with a portion close to the communication opening and closing portion 4 within the receiving bag portion 2, it is possible to readily feasibly design a structure of the cover member 3 that may cover almost all the portion from the finger tip to the bottom portion of the glove member 1 and that is provided integrally with the receiving bag portion 2 to thereby provide a structure that is much more excellent in practical use.

Also, for example, if the cover member 3 is provided with the attaching and detaching means that may attach and detach the cover member 3 with respect to the glove member 1 or the receiving bag portion 2, for example, it is possible to wash the cover member 3 by separating the cover member 3 from the glove member 1, which is much more excellent in practical use.

Also, for example, if a slit portion 5 is formed in the bottom portion of the cover member 3, and a fastening belt 6 externally mounted around a wrist portion of the glove member 1 from this slit portion 5 is exposed so that the fastening belt 6 may be arranged on the outside of the wrist portion of the cover member 3, the cover member 3 covers the glove member 1 so as not to deteriorate the function of the fastening belt 6 that is originally provided in the cold proof glove such as a snow board glove or a ski glove. Also, it is possible to fasten and fix the cover member by utilizing this fastening belt 6 so that the cover member 3 would hardly be pulled away. Thus, it is possible to provide the cold proof glove having the structure that is much more superior in practical use.

Invention according to the Seventh Aspect

Since the glove member 9 may be received in the receiving bag portion 8 provided along the sleeve portion 70, the appearance is not different from that of the regular wear on appearance. Also, thus, the glove member 9 is not any obstruction (when the manual work is to be done) when the glove member 9 is not used. Accordingly, it is possible for the user to wear the glove provided wear according to the present invention without paying any attention to the outer appearance even when the glove is not necessary.

When the glove provided wear according to the invention is worn, if the hand feels cold, it is possible to mount the glove member 9 on the hand exposed from the cuff 70A while being pulled out from the receiving bag portion 8 so that this glove member 9 covers at least all the hand to obtain the cold proof effect to the hand without fail. Also, the opening portion is not provided in the palm portion in this glove member 9 as in the conventional case, the palm portion exhibits the same gripping force as that of the conventional means by the palm portion when the object is gripped by the glove member 9.

Accordingly, if the glove provided wear according to the invention is provided, it is possible to obtain the cold proof effect to the hand by the glove member 9 as necessary even if the glove is not carried separately.

Also, there is no fear that the glove member 9 provided integrally with the receiving bag portion 8 or the sleeve portion 70 of the wear member 7 is fallen down and lost.

Incidentally, the description of the "hand" in the seventh aspect covers a broad means including not lonely the "bare hand" and the "hand" wearing the glove, and in the case where the "hand" means the hand wearing the glove, the glove member 9 according to the invention functions as a so-called over mitten for improving the cold proof property to the hand more than the glove.

Namely, it is possible to mount the glove member 9 from above the glove worn on the bare hand. It is thus possible to further enhance the cold proof property to the overall the glove (bare hand). This structure is effective particularly for the winter mountain climbing, a snow board play or a sky wear.

Even in this case, there is no work that the glove member is carried separately away from the glove as in the conventional over mitten and there is no fear that the glove member is fallen down and lost.

Also, for example, if the receiving bag portion 8 is provided on the hand back side of the sleeve portion 70, the opening portion 8A of this receiving bag portion 8 is provided in a portion close to the cuff 70A of the sleeve portion 70 and the receiving deep side of this receiving bag portion 8 is located on a proximal side of the sleeve portion 70, and if the hand back side portion of the bottom portion of the glove member 9 is provided integrally with the hand back side portion of the sleeve portion 70 or the receiving bag portion 8, for example, the glove member 9 pulled out from the receiving bag portion 8 is exposed to the extension side of the sleeve from the cuff 70A, it is possible to feasibly design the glove member 9 in low cost and easily a structure that may be mounted on the hand exposed from the cuff 70A. In addition, it is possible to readily mount the glove member 9, exposed from the opening portion 8A of this receiving bag portion 8, onto the hand on the sleeve extension side of the cuff 70A. Furthermore, when the glove member 9 is mounted on the hand, the joint portion 10 between the receiving bag portion 8 or the sleeve portion 70 and this glove member 9 is located on the hand back side. By the joint portion 10, the snow, water or cold water may be prevented from entering the cuff 70A or the glove member 9 (the cuff portion thereof) from the outside (hand back side) of the body, for example. Thus, it is possible to provide the glove that is much more excellent in practical use.

Also, for example, if the opening portion 8A of the receiving bag portion 8 is openable and closeable, and the glove member 9 is adapted to be received and pulled out from the receiving bag portion 8 through the opening portion 8A that has been opened, the opening portion 8A is closed by receiving the glove member 9 in the receiving bag portion 8 so that the glove member 9 is not exposed to the outer appearance of the wear member 7 without fail so that the same good outer appearance as that of the regular wear may be exhibited without fail.

Also, for example, if the joint portion 10 between the receiving bag portion 8 or the sleeve portion 70 of the wear member 7 and the glove member 9 or the glove member 9 has expandability, since the glove member 9 itself or the joint portion between the receiving bag portion 8 or the sleeve portion 70 of the wear portion 7 and the glove member 9 has the expandability, the glove member 9 or the joint portion 10 expands to the receiving bag portion 8 or the sleeve portion 70. It is possible to readily perform the attaching and detaching of the glove member 9 with respect to the glove member 9 to the hand exposed from the cuff 70A. In addition, it is possible to obtain the comfortable wear feel without any unusual feed in moving the body while the glove member 9 and the sleeve portion 70 being extended when the glove member 9 is worn.

Also, for example, if the glove member 9 is provided with an attaching and detaching means which is capable of attaching and detaching the glove member 9 with respect to the sleeve portion 70 of the wear 7 or the receiving bag portion 8, for example, it is possible to readily to clean the glove member 9 by separating it from the wear member 7 through the attaching and detaching means, which is much more excellent in practical use.

Embodiment 1

A first specific embodiment of the present invention will now be described with reference to FIGS. 1 to 3.

As shown in FIG. 1, in the first embodiment, the invention is applied to a five-finger type glove (cold proof glove) provided with a fastening belt 6 in its wrist portion, which may be used for, for example, ski or snow board play.

A receiving bag portion 2 is provided on a back portion of a glove member 1. A mitten type cover member 3 that may cover almost all the glove member 1 from a finger tip to a bottom edge is received in this receiving bag portion 2 so that it may be taken out therefrom if necessary. This cover member 3 is provided integrally with the glove member 1 or the receiving portion 2 without separation.

More specifically, as shown by the phantom line in FIG. 1, the receiving bag portion 2 is received from the back portion to the bottom edge portion of the glove member 1. A communication opening and closing portion 4 that makes the outside of this glove member 1 and the interior of the above-described receiving bag portion 2 communicated with each other and that may be openable as desired is provided on the outer surface of the bottom edge portion of the above-described glove member 1. The above-described cover member 3 may be taken out from the receiving bag portion 2 through the opened communication opening and closing portion 4.

Also, the communication opening and closing portion 4 may be opened and closed by a fastener 4A so that the opening and closing operation may readily be performed.

Incidentally, it is also possible to receive other materials together with the cover member 3 in this receiving bag portion 2 or to receive therein a temperature keeping agent such as a portable heater for enhancing the temperature keeping property.

Figure 3:
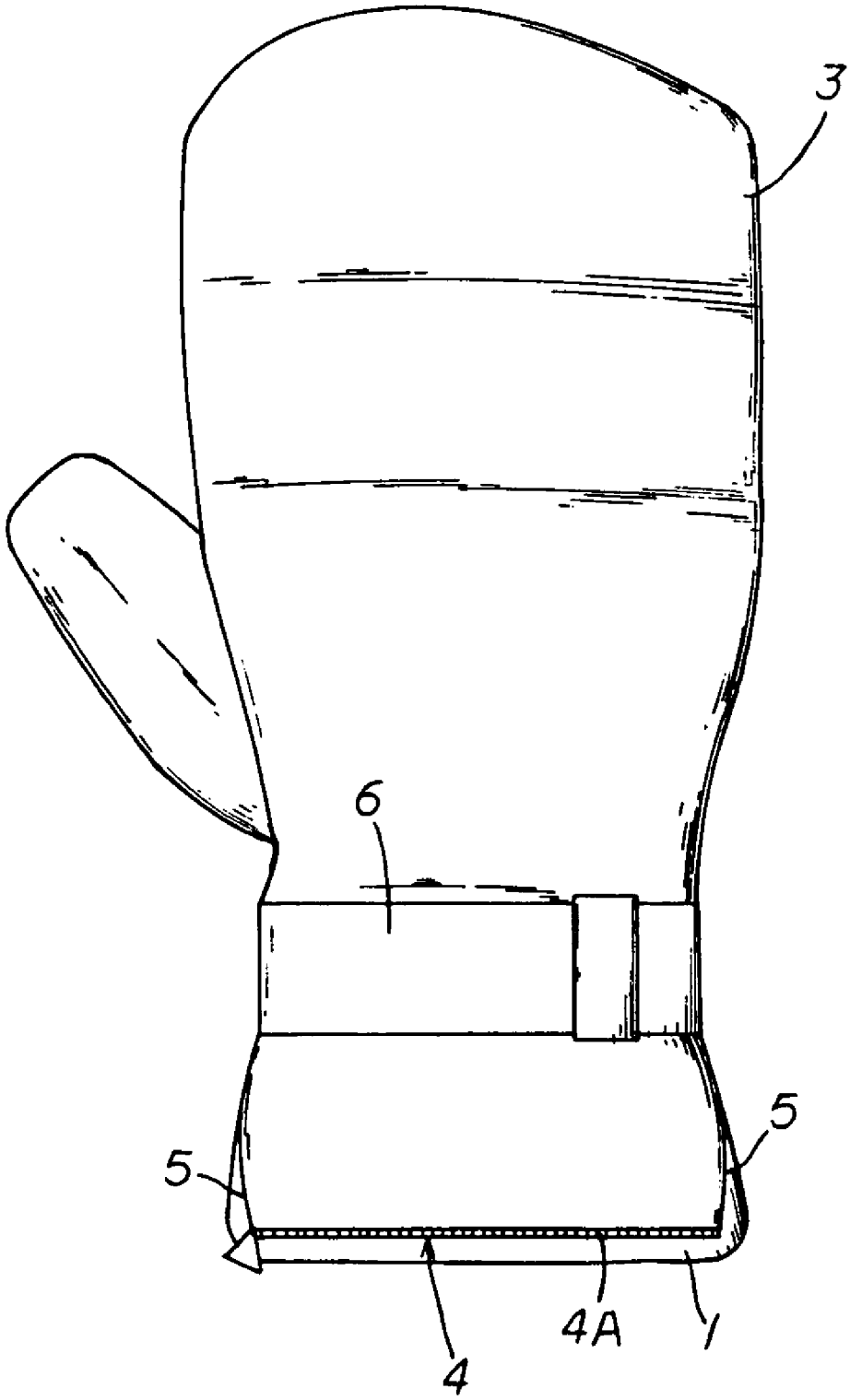
FIG. 3 is a frontal view showing a condition in which the cover member covers the glove member of the first embodiment.

As shown in FIG. 3, the cover member 3 is of the two finger type and mitten type to cover all five fingers and to cover almost all the glove member 1 to the cuff edge. Namely, this cover member has the same structure as that of the conventional over mitten.

Figure 2:
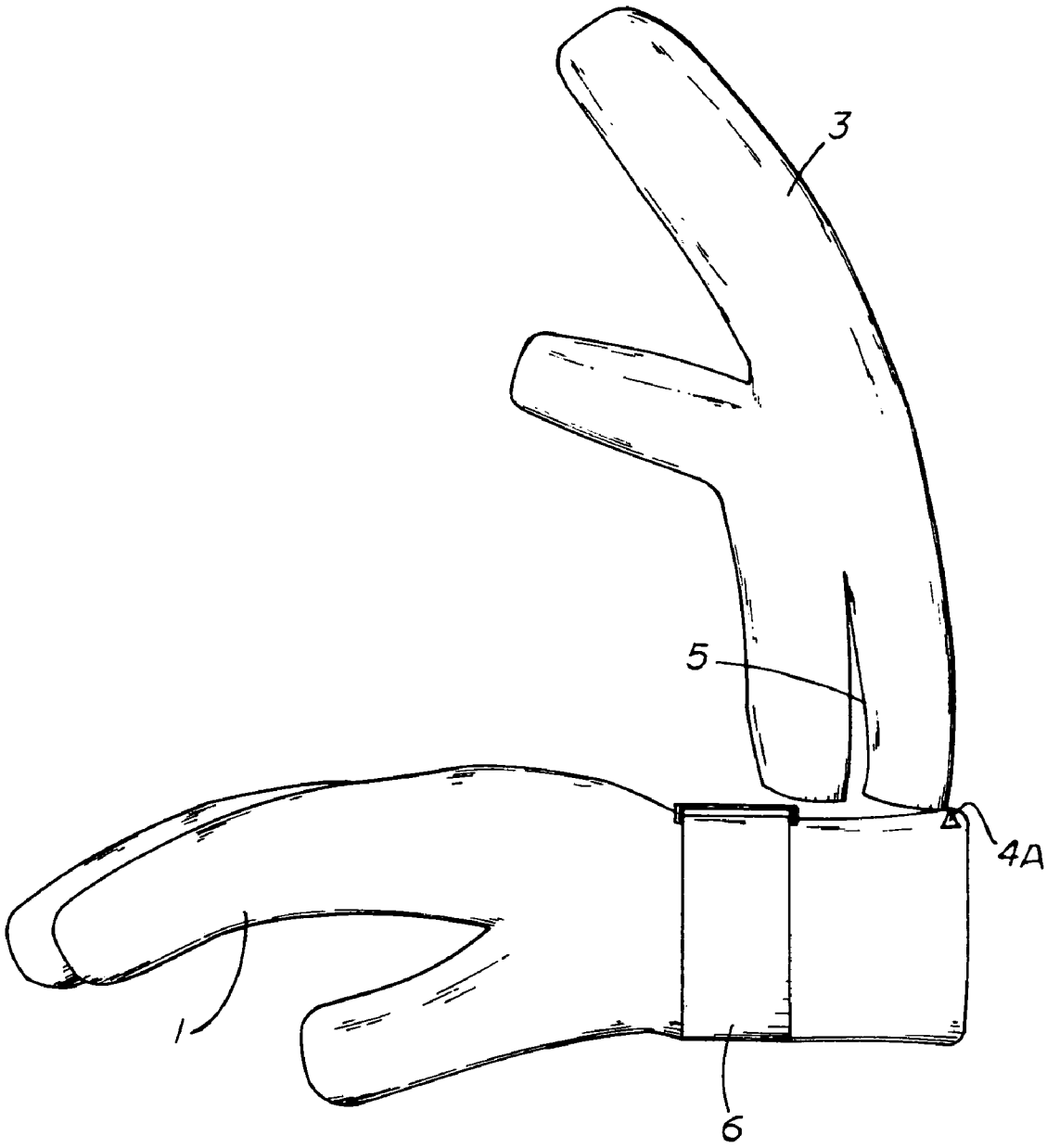
FIG. 2 is a side elevational view showing a condition that a cover member has been pulled out from a receiving bag portion of the first embodiment.

Also, the back side portion of the cuff edge of the cover member 3 is stitched to the portion close to the above-described opening and closing portion 4 of the above-described receiving bag portion 2 to be integral with the receiving bag portion 2 (see FIG. 2).

Also, as shown in FIG. 2, slit portions 5 are formed on both right and left sides of the cover member 3 in the range from the cuff edge portion substantially to the wrist position toward the finger tip.

The slit portions 5 are used to expose the fastening belt 6 to the outside from the cover member 3 when the glove 1 is covered by the cover member 3. Thus, the function of the fastening belt 6 is not degraded and the cover member 3 may be fastened by utilizing the fastening belt 6 so that the cover member 3 is hardly removed.

Also, in this embodiment, a suitable attaching/detaching means (not shown) for attaching to and detaching from the receiving bag portion 2 the cover member 3 is provided. For example, when the cover member 3 is desired to be washed, the cover member 3 may be separated from the glove member 1 through the attaching/detaching means.

Incidentally, in this embodiment, the glove member 1 is of the five finger type but it is possible to use the glove member 1 of the mitten type (two-finger type and three-finger type).

Also, in this embodiment, the case where the communication opening and closing portion 4 is provided on the outer surface of the cuff edge portion of the glove member 1 is shown but it is possible to provide the communication opening and closing portion 4 on the inner surface of the cuff edge portion of the glove member 1.

Also, in this embodiment, the case where the cover member 3 is of the two-finger type mitten type is shown but it is possible to use the three-finger type mitten type cover member in which the forefinger portion is separated from the other portion.

Also, it is possible to impart to the cover member 3 a goggle blade function of removing fog or water drops on goggles or glasses, a water proof function, a water splashing function, a gripping function by adopting material that is high in gripping property to the palm portion, or a still further water proof function by using temperature keeping material.

Incidentally, the present invention is not limited to or by the present embodiment but it is possible to change the specific structure of each component suitably.

Embodiment 2

A second specific embodiment of the present invention will now be described with reference to FIGS. 4 to 6.

Figure 4:
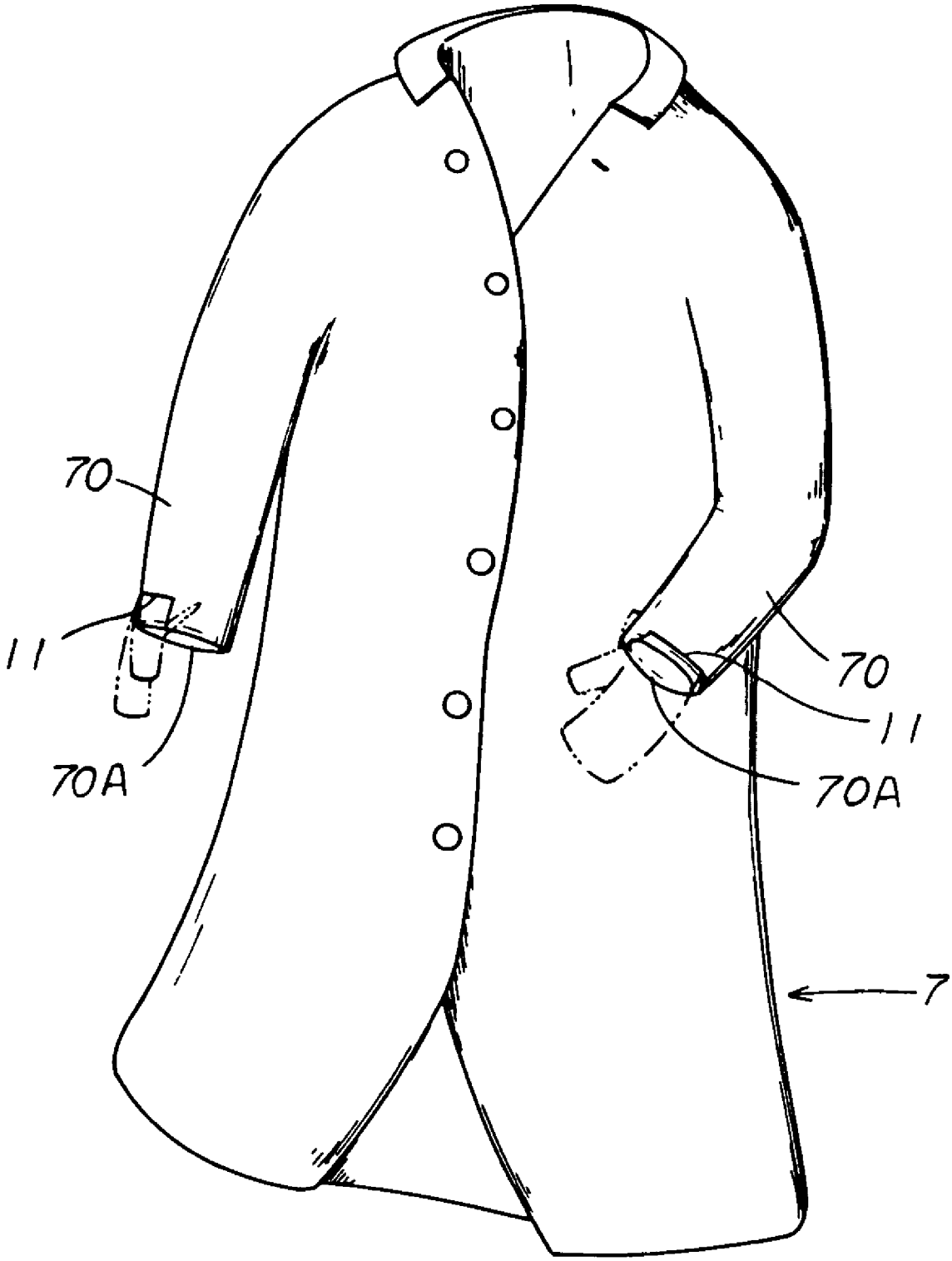
FIG. 4 is a perspective view showing a second embodiment.

As shown in FIG. 4, in this embodiment, the invention is applied to an over coat as a wear member 7.

A receiving bag portion 8 is provided along a long sleeve portion 70 of the wear member 7. A glove member 9 that may cover all the hand is received in this receiving bag portion 8 so that the glove member 9 may be taken out therefrom as desired. This glove member 9 is provided integrally with the receiving bag portion 8.

Figure 5:
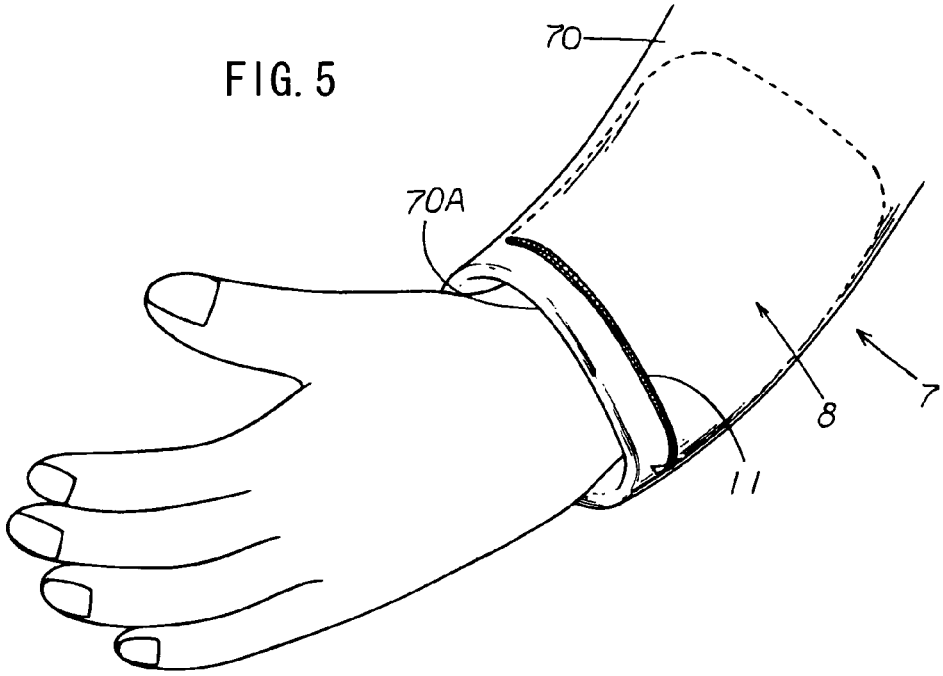
FIG. 5 is a partially illustrative view showing the receiving condition of the glove member according to the second embodiment.
Figure 6:
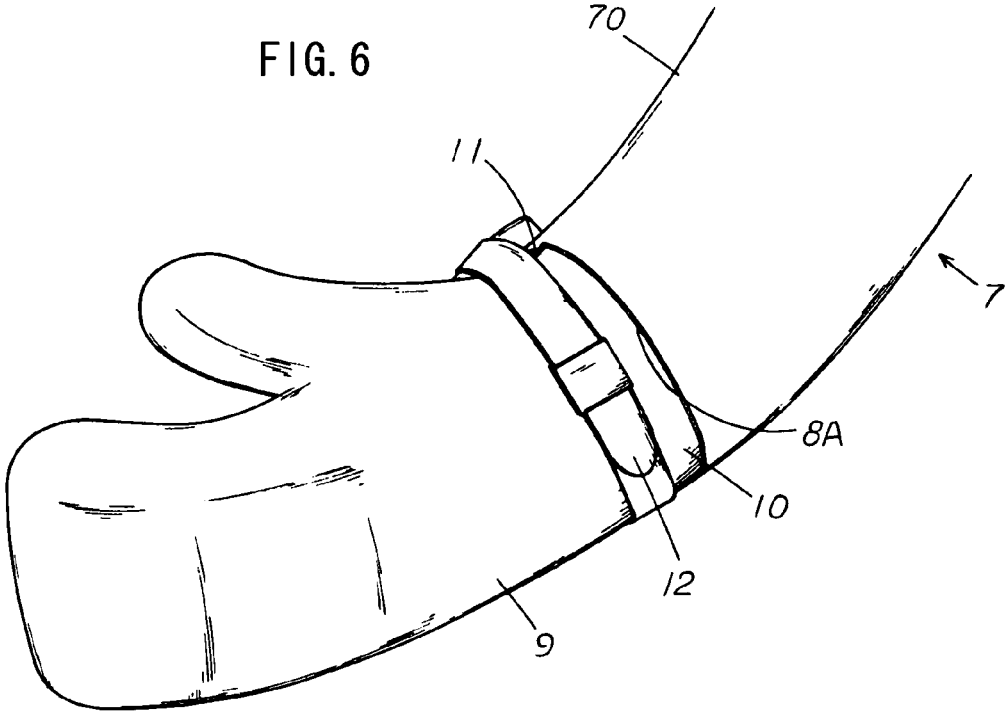
FIG. 6 is the partially illustrative view showing the receiving condition of the glove member according to the second embodiment.

More specifically, as shown by the phantom line in FIG. 5, the receiving bag portion 8 is internally provided along the sleeve portion 70 in the portion close to a cuff 70A (cuff edge) of a hand back side of each sleeve portion 70 of the wear member 7.

Also, an opening portion 8A of this receiving bag 8 is formed on an outer surface in the vicinity of the cuff 70A of the sleeve portion 70 with a receiving deep side of this receiving bag 8 being located on a proximal side of the sleeve portion 70. As shown in FIG. 6, the glove member 9 may be pulled out and received through the opening portion 8A.

Also, a fastener 11 is provided along this opening portion 8A so that the opening portion 8A may be opened and closed as desired. The opening and closing operation may readily be performed by the fastener 11. Accordingly, the opening and closing structure of this opening portion 8A may readily be designed and is superior in mass productivity. Incidentally, the opening and closing structure of this opening portion 8A is not limited to the fastener 11 but may be modified to any other opening and closing structure such as an opening and closing structure by male and female engagement tapes or an opening and closing structure by hooks.

Incidentally, it is possible to receive the other object or a warmer agent such as a portable body warmer together with the glove member 9 in this receiving bag 8.

The glove member 9 is of the conventional two-finger and mitten type covering all five fingers of the hand and covering almost all the wrist. If the glove member 9 is adopted so that also the wrist is substantially covered in this manner, it is possible to prevent rain or wind from entering from the cuff 70A upon wearing this glove member 9 as much as possible.

Also, a fastening belt 12 is provided around a portion of the glove member 9 covering the wrist. The wearing condition to the hand may be kept well by fastening this fastening belt 12 to the wrist.

Also, for example, if a slit is formed at the cuff portion of the glove member, it is easy to mount the glove member to the hand.

Also, in the joint structure between the receiving bag portion 8 and the glove member 9 in this embodiment, the receiving bag 8 and the glove member 9 are integrated with each other through a joint portion 10.

More specifically, the cuff portion of the above described glove member 9 is integrated with one end portion of the joint portion 10. The other end portion is integrated with a portion in the vicinity of the above-described opening portion 8A of the above-described receiving bag 8. Also, this joint portion 10 is made of material having expandability.

Furthermore, one end portion of a cloth member having an expandability as the joint member 10 is stitched to a range of substantially half a portion of the overall circumference of the cuff of the glove member 9 and that is a portion on the hand back side out of the cuff portion of the glove member 9. This joint portion 10 is provided integrally with an extension side of the cuff portion of the glove member 9. The extension end portion (the other end portion) of this joint portion 10 is stitched to a portion in the vicinity of the above-described opening portion 8A of the receiving bag portion 8.

Accordingly, the joint structure between the receiving bag portion 8 and the glove member 9 may readily be designed. Also, since the receiving bag portion 8 (opening portion 8A) is provided in the vicinity of the cuff tip as described above, the joint portion 10 may be made of a short material in low cost.

Also, since the cuff portion of the glove member 9 is on the hand back side and is integrated with the joint portion 10 along about half the overall circumference of the cuff portion, when the glove member 9 is worn on the hand, the joint portion 10 between this glove member 9 and the receiving bag portion 8 is adapted to cover the wide range on the hand back side so that snow, water, cold air and the like may be prevented from entering the cuff portion of the glove member 9 or the cuff 70A from the outside (from the hand back side) of the body.

Also, since the joint portion 10 has the expandability, when the glove member 9 is worn, there is no fear that the cuff portion 70 would be expanded, to thereby ensure the good wear feel.

Also, in this embodiment, an attaching and detaching means for making possible to attach on and detaching from the receiving portion 8 the glove member 9 is provided.

Although this attaching and detaching means is not shown in detail, for example, it is sufficient to adopt an easy-to-handle structure that may separate the joint portion 10 by providing a fastener to the above-described joint portion 10. Accordingly, it is possible to readily separate the glove member 9 from the wear 7 through this attaching and detaching means to thereby make it possible to readily perform activities such as cleaning of the glove member 9.

How to use glove provided wear according to the present embodiment will now be described.

The glove provided wear according to this embodiment is worn.

If the glove member 9 is to be used, the glove member 9 is pulled out from the receiving bag portion 8 and is worn to the hand exposed from the cuff 70A of the sleeve portion 70. Then, this glove member 9 covers a portion from the hand to the wrist of the user. Thus, it exhibits the cold proof effect.

Then, the glove member 9 is turned back through about 180 degrees using the joint portion 10 as a turning pivot (with the finger tip side of the glove member 9 being positioned on the wrist side). After that, if the glove member 9 is received in the receiving bag portion 8 from this finger tip side and the fastener 11 is fastened, the glove member 9 is received under the condition that it is not seen as a whole.

Accordingly, since the glove member 9 is received so that this glove member 9 would not serve as an obstacle against the hand work and the external appearance is the same as that of usual wear, the glove provided wear according to this embodiment may be worn without pay any attention to the external appearance even if the glove member 9 is not needed.

Also, when the glove member 9 is to be attached or detached, although the glove member 9 and the receiving member 8 are integrated with each other through the joint portion 10, since this joint portion 10 has the expandability, the joint portion does not work as a resistance and the operation may readily be performed.

Incidentally, the glove provided wear according to this embodiment may exhibit the cold proof effect (water proof effect) by the glove member 9 while the glove member is applied to any other wear other than the glove provided wear or over coat such as, for example, ski, snow board play, mount climbing, golf, motor cycling, biking, fishing, working wear or the like.

Also, for example, if the invention is applied to wear for ski, snow board play or the like, it is effective that the glove member 9 is used as the over mitten (mitten worn on the glove). Incidentally, in this embodiment, the glove member 9 has the same structure as that of the conventional one, such an application is performed without causing any problem. Namely, the glove member 9 according to this embodiment is constructed as a mitten type so that almost all the portion from the finger tip end to the cuff portion of the glove that is available on the market. The mitten is thus used, the mitten may be used as a further cold proof measure when it is closed in a mountain area. In addition, it is unnecessary to carry a discrete over mitten separately and there is no fear that the mitten is fallen down and lost away. Thus, the mitten may be used in a very practical manner.

Also, although the case is shown in the present embodiment where the receiving bag portion 8 is provided on the hand back portion of the sleeve portion 70 of the wear, it is possible to provide the receiving bag portion 8 to another portion such as the palm side portion of the sleeve portion 70.

Also, although the case is shown in the present embodiment where the opening portion 8A is provided on the outer surface of the sleeve portion 70, it is possible to provide the opening portion 8A to the inner surface of the sleeve portion 70 or to provide the opening portion 8A to the sleeve portion of the cuff 70A.

Also, although the case is shown in the present embodiment where the glove member 9 is formed into the two-finger mitten type one, it is possible to form the glove member into the three-finger mitten type in which the forefinger is separated from the other or to the five-finger type glove member 9 that is not of the mitten type.

Also, it is possible to impart the goggle blade function for removing water drop or fog on the glasses, goggles or the like to the glove member 9, or to impart the water proof function, the water splashing function, the gripping function by adopting the material having a high gripping function on the palm portion or to impart the further cold proof function to the glove member 9 with the temperature keeping material.

Incidentally, the present invention is not limited to or by the above-described embodiment but it is possible to change a design of a specific structure of each component suitably.

What is claimed is:

1. A cold proof glove comprising:

a fastening belt externally mounted around a wrist portion of a glove member and a receiving bag portion provided in a back hand portion of the glove member, wherein a mitten type cover member, which covers almost all the glove member from its finger tip to its bottom portion, is arranged and received in such a manner that the cover member may be pulled out as desired, and said cover member is provided integrally with at least one of the glove member and the receiving bag portion without separating therefrom, and a slit portion is formed in the bottom of the right and left sides of said cover member, and said fastening belt is externally provided on the wrist portion of said glove member through said slit portion and is exposed so that said fastening belt may be provided outside of the wrist portion of the cover member.

2. The cold proof glove according to claim 1, wherein a communication opening and closing portion, which may be opened and closed as desired, so that communication occurs between an outside portion of said glove member and an inside portion of said receiving bag portion is provided in a sleeve portion of said glove member, and said cover member is adapted to be capable of being received in and pulled out from the receiving bag portion through the communication opening and closing portion which is opened.

3. The cold proof glove according to claim 2, wherein a part of the bottom portion of said cover member is provided integrally with a portion close to said communication opening and closing portion within said receiving bag portion.

4. The cold proof glove according to any one of claims 1 to 3, further comprising an attaching and detaching means for attaching and detaching said cover member with respect to one of said glove member and said receiving bag member.

* * * * *